US008472846B2

(12) United States Patent
Watanabe et al.

(10) Patent No.: US 8,472,846 B2
(45) Date of Patent: Jun. 25, 2013

(54) DEVELOPER COLLECTION CONTAINER HAVING FIRST AND SECOND DEVELOPER CONVEYANCE MEMBERS

(75) Inventors: Kaoru Watanabe, Yokohama (JP); Kazuaki Iikura, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 325 days.

(21) Appl. No.: 12/948,429

(22) Filed: Nov. 17, 2010

(65) Prior Publication Data

US 2011/0222941 A1 Sep. 15, 2011

(30) Foreign Application Priority Data

Mar. 11, 2010 (JP) ..... 2010-054212

(51) Int. Cl.
*G03G 15/08* (2006.01)

(52) U.S. Cl.
USPC ..... 399/257

(58) Field of Classification Search
USPC ..... 399/360, 358, 257
See application file for complete search history.

(56) References Cited

U.S. PATENT DOCUMENTS

| | | | | |
|---|---|---|---|---|
| 5,933,690 | A * | 8/1999 | Sugimoto et al. | 399/257 |
| 7,292,817 | B2 * | 11/2007 | Murakami et al. | 399/358 |
| 8,131,183 | B2 * | 3/2012 | Ito | 399/358 |
| 8,145,101 | B2 * | 3/2012 | Terai et al. | 399/257 |
| 8,150,307 | B2 * | 4/2012 | Kudo | 399/360 |
| 2011/0222940 | A1 * | 9/2011 | Sakuma | 399/358 |

FOREIGN PATENT DOCUMENTS

JP 2004-198789 A 7/2004

* cited by examiner

*Primary Examiner* — Susan Lee
(74) *Attorney, Agent, or Firm* — Sughrue Mion, PLLC

(57) ABSTRACT

A developer collection container includes: a developer collection container main body that forms a developer collection chamber in which developer is collected; a first developer conveyance member, provided inside the developer collection container main body, that conveys the developer by rotating about a shaft; and a second developer conveyance member, provided below the first developer conveyance member with respect to a gravitational direction in the developer collection container main body, that conveys the developer by rotating about a shaft, the developer collection container main body having a collected developer introduction member that introduces the developer to the developer collection chamber being provided between the first developer conveyance member and the second developer conveyance member with respect to the gravitational direction.

7 Claims, 9 Drawing Sheets

DEVELOPER COLLECTION CONTAINER HAVING FIRST AND SECOND DEVELOPER CONVEYANCE MEMBERS

CROSS-REFERENCE TO RELATED APPLICATIONS

This application is based on and claims priority under 35 USC 119 from Japanese Patent Application No. 2010-054212 filed Mar. 11, 2010.

BACKGROUND

Technical Field

The present invention relates to a developer collection container and an image forming apparatus.

SUMMARY

According to an aspect of the present invention, there is provided a developer collection container including: a developer collection container main body that forms a developer collection chamber in which developer is collected; a first developer conveyance member, provided inside the developer collection container main body, that conveys the developer by rotating about a shaft; and a second developer conveyance member, provided below the first developer conveyance member with respect to a gravitational direction in the developer collection container main body, that conveys the developer by rotating about a shaft, the developer collection container main body having a collected developer introduction member that introduces the developer to the developer collection chamber being provided between the first developer conveyance member and the second developer conveyance member with respect to the gravitational direction.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described based on the drawings.

Figure 1:
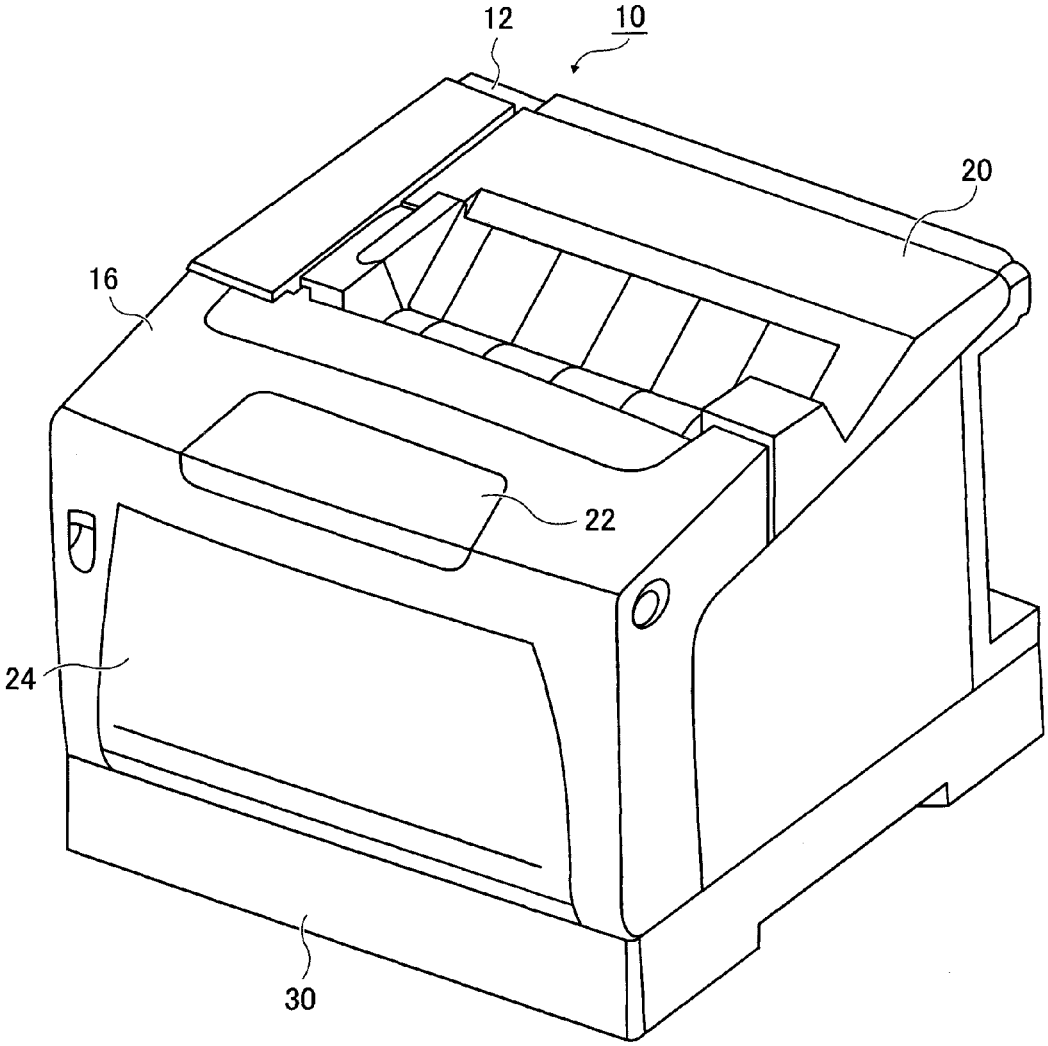
FIG. 1 is a perspective diagram showing an image forming apparatus to which an exemplary embodiment of the present invention is applied.
Figure 2:
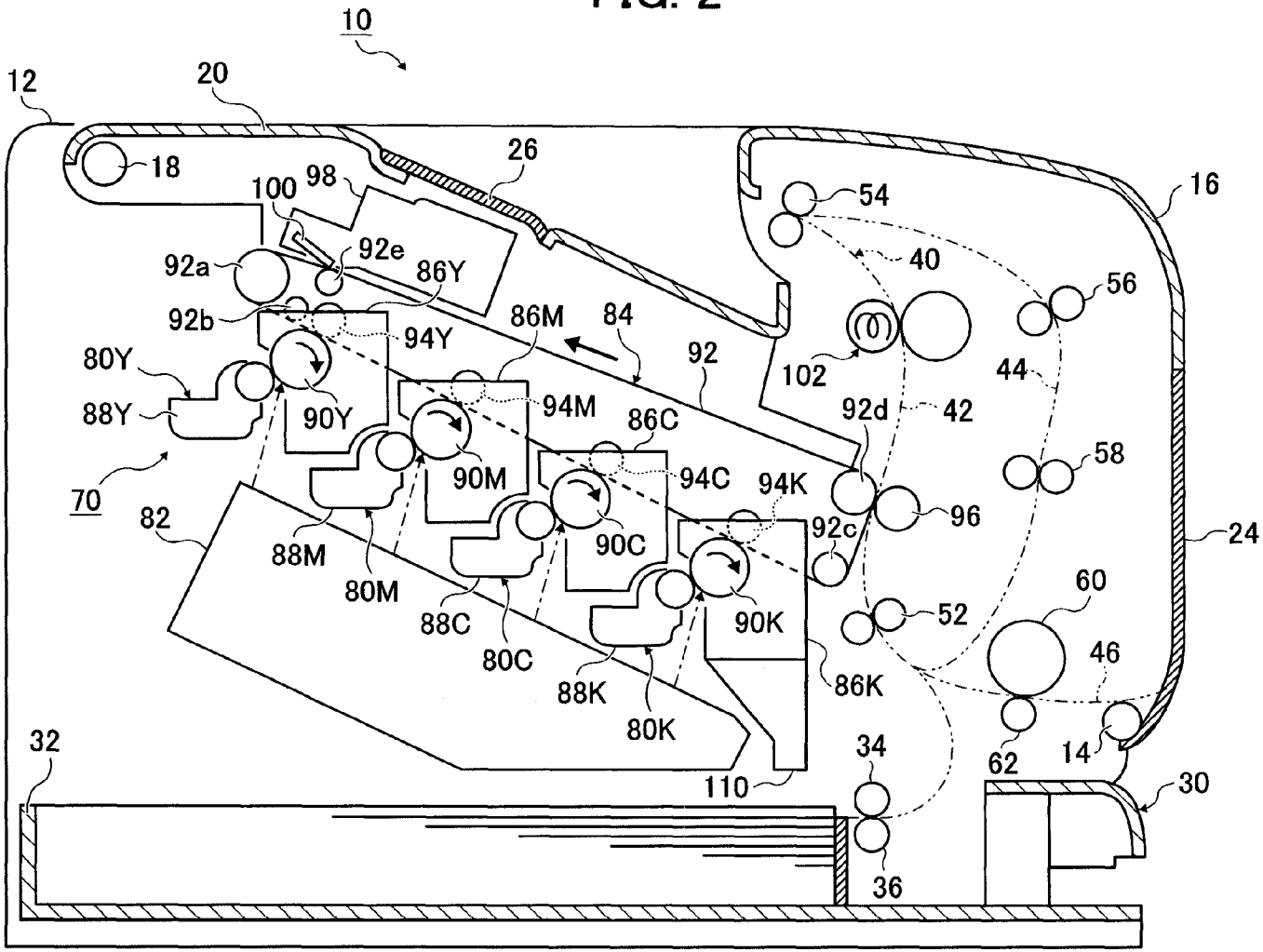
FIG. 2 is a cross-sectional diagram showing the image forming apparatus to which the exemplary embodiment of the present invention is applied.

FIG. 1 is a perspective diagram showing an image forming apparatus 10 as an exemplary embodiment of the present invention. FIG. 2 is a cross-sectional diagram showing the image forming apparatus 10.

The image forming apparatus 10 has an image forming apparatus main body 12. A frontward opening/closing member 16 opened/closed frontward (rightward in FIG. 2) via a hinge 14 is attached to the image forming apparatus main body 12. Further, an upward opening/closing member 20 opened/closed upward via a hinge 18 to the image forming apparatus main body 12.

An operation unit 22 is provided in front part of the image forming apparatus main body 12. The operation unit 22 has ten keys to input the number of recording media for image formation, a start key operated at the start of image formation and the like. Note that a recording medium is a normal paper sheet, an OHP sheet or the like on which an image is finally formed.

A supply opening/closing member 24 is attached frontward openably/closably to the frontward opening/closing member 16. At normal times, the supply opening/closing member 24 is closed with respect to the frontward opening/closing member 16, and the supply opening/closing member 24 is opened when the recording media are supplied to a sub conveyance passage 46 to be described later.

The upward opening/closing member 20, in which a recording medium where an image is formed is discharged on its upper surface, is used as a discharge unit. A sub opening/closing member 26 openable/closable with respect to the upward opening/closing member 20 is attached to the upward opening/closing member 20. The sub opening/closing member 26 can be opened/closed independently of the upward opening/closing member 20. In a state where the upward opening/closing member 20 is closed with respect to the image forming apparatus main body 12, the sub opening/closing member 26 can be opened with respect to the upward opening/closing member 20.

The upward opening/closing member 20 is opened when photoreceptor units 86Y, 86M, 86C and 86K and a developer collection container 110, to be described later, are attached/removed in/from the image forming apparatus main body 12.

When the frontward opening/closing member 16 is opened prior to the opening of the upward opening/closing member 20, an intermediate transfer belt 92 and the like to be described later, attached to the upward opening/closing member 20, can be prevented from interfering with the frontward opening/closing member 16.

When the frontward opening/closing member 16 is closed, the upward opening/closing member 20 is closed prior to the closing of the frontward opening/closing member 16.

In a lower position in the image forming apparatus main body 12, a recording medium supply device 30 to supply the recording medium to an image forming unit 70 to be described later is attached. The recording medium supply device 30 can be pulled out to the front side of the image forming apparatus main body 12 (right side in FIG. 2). In a state where the recording medium supply device 30 is pulled out of the image forming apparatus main body 12, the recording media are plenished.

The recording medium supply device 30 has a recording medium container 32 which holds recording media such as normal paper sheets in a stacked state. Further, the recording medium supply device 30 has a conveyance roller 34 to pick up a top recording medium held in the recording medium container 32 and convey the picked recording medium toward the image forming unit 70, and a retard roller 36 to retard the recording medium so as to prevent multi-feed of plural recording media in an overlapped state to the image forming unit 70.

A conveyance passage 40 used for conveyance of the recording medium is formed in the image forming apparatus main body 12. The conveyance passage 40 has a main conveyance passage 42, a reversing conveyance passage 44 and a sub conveyance passage 46.

The main conveyance passage 42 conveys a recording medium supplied from the recording medium supply device 30 to the image forming unit 70, and discharges the recording medium on which an image is formed to the outside the image forming apparatus main body 12. Along the main conveyance passage 42, sequentially from an upstream side in a conveyance direction of the recording medium, the conveyance roller 34 and the retard roller 36, a registration roller 52, a second transfer roller 96 to be described later, a fixing device 102 to be described later, and a discharge roller 54, are provided.

The registration roller 52 temporarily stops an end of the recording medium conveyed form the side of the recording medium supply device 30, and sends the recording medium toward the second transfer roller 96 at timing of image formation.

The discharge roller 54 discharges a recording medium on which respective color toner are fixed with a fixing device 102 to be described later to the outside the image forming apparatus main body 12.

A reversing conveyance passage 44 is a conveyance passage to resupply a recording medium, where a developer image is formed on one surface, while reversing the recording medium, toward the image forming unit 70. Along the reversing conveyance passage 44, for example, two reversing conveyance rollers 56 and 58 are provided.

When the recording medium is conveyed from the main conveyance passage 42 to the discharge roller 54, and the discharge roller 54 reverse-rotates in a state where the rear end of the recording medium is held with the discharge roller 54, the recording medium is supplied to the reversing conveyance passage 44. The recording medium supplied to the reversing conveyance passage 44 is conveyed to a position upstream of the registration roller 52 with the reversing conveyance rollers 56 and 58.

The sub conveyance passage 46 is a conveyance passage to supply a special recording medium, which has e.g. size and/or paper quality different from that of the recording media contained in the recording medium supply device 30, to the image forming unit 70. The recording medium is supplied from the front side of the image forming apparatus main body 12 to the sub conveyance passage 46 in a state where the supply opening/closing member 24 is opened. The sub conveyance passage 46 is provided with a conveyance roller 60 to convey the recording medium supplied to the sub conveyance passage 46 toward the image forming unit 70 and a retard roller 62 to retard the recording medium supplied to the sub conveyance passage 46 so as to prevent multi-feed of plural recording media in an overlapped state to the image forming unit 70.

The image forming unit 70 which forms an image on a recording medium is provided in the image forming apparatus main body 12. The image forming unit 70 has, for example, four developer image forming units 80Y, 80M, 80C and 80K, an optical writing device 82 and a transfer device 84.

The developer image forming units 80Y, 80M, 80C and 80K respectively form developer images using Y (yellow), M (magenta), C (cyan) and K (black) developers.

Note that in the following description, the image forming units may be generically referred to as a developer image forming unit 80 without alphabet Y, M, C or K. Similarly, other constituent elements corresponding to respective colors may be generically referred (as photoreceptor unit 86, a developing device 88, and the like).

The developer image forming units 80Y, 80M, 80C and 80K respectively have photoreceptor units 86Y, 86M, 86C and 86K and developing devices 88Y, 88M, 88C and 88K.

The photoreceptor units 86 are arrayed sequentially from the rear side of the image forming apparatus main body 12 (left side in FIG. 2) as the photoreceptor units 86Y, 86M, 86C and 86K.

The photoreceptor units 86Y, 86M, 86C and 86K are respectively used as an image forming structure and respectively have photoreceptor drums 90Y, 90M, 90C and 90K.

The photoreceptor drum 90 is used as an image holder.

The developing devices 88Y, 88M, 88C and 88K develop latent images formed on the corresponding photoreceptor drums 90Y, 90M, 90C and 90K using respectively contained Y, M, C and K developers.

The optical writing device 82 which is used as a latent image forming device irradiates the photoreceptor drum 90 with light, thereby forms latent images on the respective surfaces of the photoreceptor drums 90Y, 90M, 90C and 90K.

The transfer device 84 has the intermediate transfer belt 92 used as a transfer body, first transfer rollers 94Y, 94M, 94C and 94K used as first transfer devices, a second transfer roller 96 used as a second transfer device, and a cleaning device 98.

The intermediate transfer belt 92 which is an endless belt is supported with e.g. five support rollers 92*a*, 92*b*, 92*c*, 92*d* and 92*e*, rotatably in an arrow direction in FIG. 2. At least one of the support rollers 92*a*, 92*b*, 92*c*, 92*d* and 92*e* is connected to a motor (not shown), and rotated upon reception of driving transmitted from the motor, to rotate-drive the intermediate transfer belt 92.

The first transfer rollers 94Y, 94M, 94C and 94K transfer developer images, formed on the surfaces of the photoreceptor drums 90Y, 90M, 90C and 90K by the respectively corresponding developing devices 88Y, 88M, 88C and 88K, onto the intermediate transfer belt 92.

The second transfer roller 96 transfers the Y, M, C and K developer images transferred onto the intermediate transfer belt 92 to a recording medium.

The cleaning device 98 has a scraping member 100 which, after transfer of the respective color developer images with the second transfer roller 96 to the recording medium, scrapes toner as respective color developers remaining on the surface of the intermediate transfer belt 92. The toner scraped with the member 100 is collected into the main body of the cleaning device 98.

The cleaning device 98 can be attached/removed in/from the image forming apparatus main body 12 via an opening formed by opening the sub opening/closing member 26.

Among elements forming the transfer device 84, the intermediate transfer belt 92, the support rollers 92*a*, 92*b*, 92*c*, 92*d* and 92*e*, the first transfer roller 94, and the cleaning device 98 are attached to the upward opening/closing member 20. The second transfer roller 96 of the transfer device 84 is attached to the image forming apparatus main body 12.

Further, the fixing device 102 to fix the developer image, transferred with the second transfer roller 96, onto the recording medium to the recording medium, is provided in the image forming apparatus main body 12.

The developer collection container 110 is provided in the image forming apparatus main body 12. The developer collection container 110 is used as a discharged developer collection container to collect the developer discharged from at least one of the plural developer image forming units 80Y, 80M, 80C and 80K.

In the present exemplary embodiment, the developers discharged from all the four developer image forming units 80Y, 80M, 80C and 80K are collected into the developer collection container 110. More particularly, in the present exemplary embodiment, the developers discharged from the respective developing devices 88Y, 88M, 88C and 88K of the developer image forming units 80Y, 80M, 80C and 80K are collected into the developer collection container 110.

The developers discharged from the developing devices 88Y, 88M, 88C and 88K are conveyed in a developer collection passage 170 (see FIG. 6) to be described later, provided in the image forming apparatus main body 12, to the developer collection container 110.

The developer collection container 110 is not limited to the structure in the present exemplary embodiment where the developer discharged from the developing device 88 of the developer image forming unit 80 is collected into the developer collection container 110. In place of this structure, or in addition to this structure, it may be arranged such that the developer discharged from the developer image forming unit 80 and discharged from another device than the developing device (for example, the developer removed from the surface of the photoreceptor drum 90) is collected into the developer collection container 110.

In the present exemplary embodiment, the developer collection container 110 is integrally formed with the photoreceptor unit 86K, and attached/removed in/from the image forming apparatus main body 12 integrally with the photoreceptor unit 86K.

The developer collection container 110 is not limited to this structure, but in place of the structure where the developer collection container 110 is integrally formed with the photoreceptor unit 86K, it may be arranged such that the developer collection container 110 is integrally formed with any one of the other photoreceptor units 86Y, 86M and 86C and attached/removed integrally with any one of these photoreceptor units 86Y, 86M and 86C.

Further, it may be arranged such that the developer collection container 110 is not integrally formed with the photoreceptor unit 86 but independently provided.

Next, the details of the photoreceptor unit 86 will be described. Note that as the photoreceptor units 86Y, 86M, 86C and 86K have the same structure except that corresponding colors are different, the photoreceptor unit 86Y will be used as a typical example in the following description.

Figure 3:
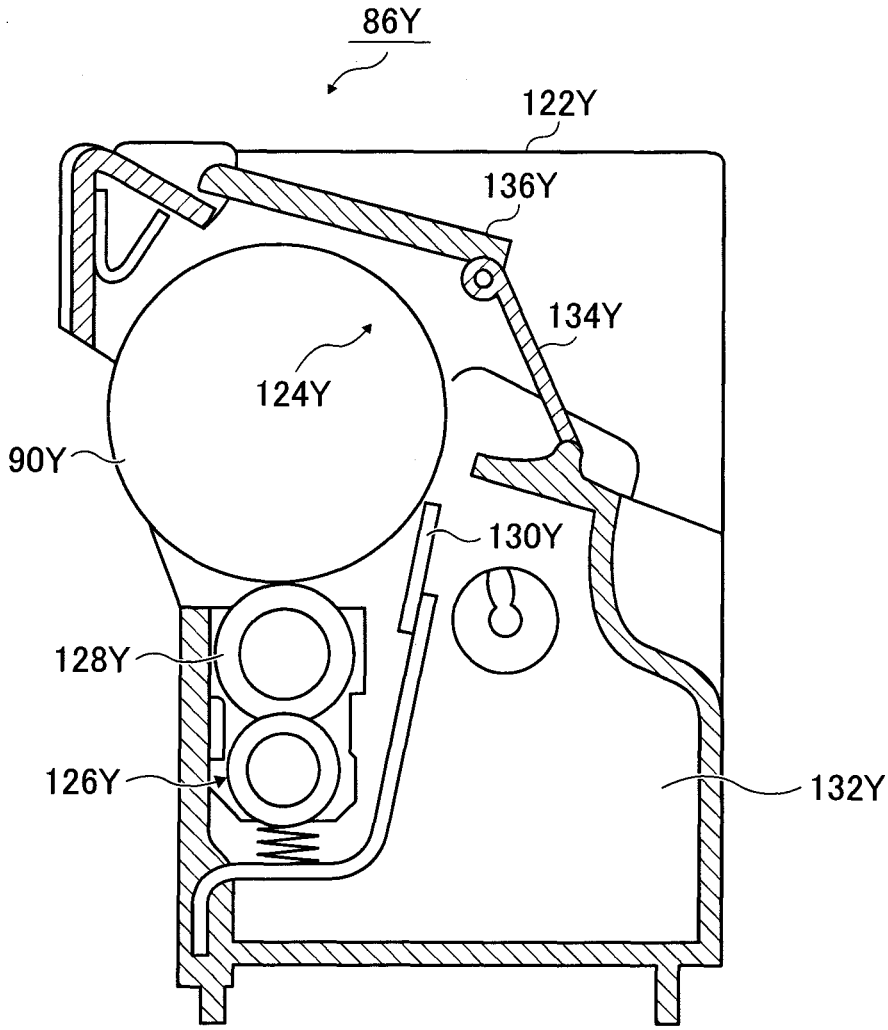
FIG. 3 is a cross-sectional diagram of a photoreceptor unit.

FIG. 3 is a cross-sectional diagram of the photoreceptor unit 86Y.

The photoreceptor unit 86Y has a photoreceptor unit main body 122Y, and the photoreceptor drum 90Y is attached in the photoreceptor unit main body 122Y. A part of the photoreceptor drum 90Y can be exposed to the outside the photoreceptor unit main body 122Y as an exposed part 124Y.

A charging device 126Y to uniformly charge the surface of the photoreceptor drum 90Y is attached in the photoreceptor unit main body 122Y. The charging device 126Y has a charging roller 128Y in contact with the photoreceptor drum 90Y. A latent image is written with the optical writing device 82 (see FIG. 2) on the surface of the photoreceptor drum 90Y uniformly charged with the charging device 126Y.

A scraping member 130Y used as a cleaning device is attached in the photoreceptor unit main body 122Y. After Y (yellow) toner as the developer has been transferred with the first transfer roller 94Y (see FIG. 2) to the intermediate transfer belt 92, the scraping member 130Y scrapes the developer remaining on the surface of the photoreceptor drum 90Y. Further, a collection chamber 132Y in which the toner scraped with the scraping member 130Y off the surface of the photoreceptor drum 90Y is collected is provided in the photoreceptor unit main body 122Y.

A shutter 136Y is attached via a support member 134Y to the photoreceptor unit main body 122Y. The support member 134Y and the shutter 136Y are used as opening/closing members to open/close by moving between a position to cover the exposed part 124Y of the photoreceptor drum 90Y (hereinbelow, referred to as a "covering position") and a position to expose the exposed part 124Y from the photoreceptor unit main body 122Y (hereinbelow, referred to as an "exposing position"). FIG. 3 shows a state where the support member 134Y and the shutter 136Y have moved to the covering position.

In a state where the photoreceptor unit 86Y is not attached to the image forming apparatus main body 12, the support member 134Y and the shutter 136Y are in the covering position. Further, in a state where the photoreceptor unit 86Y is attached to the image forming apparatus main body 12 and the upward opening/closing member 20 is opened with respect to the image forming apparatus main body 12, the support member 134Y and the shutter 136Y are in the covering position.

In a state where the photoreceptor unit 200 is attached to the image forming apparatus main body 12, when the upward opening/closing member 20 is closed with respect to the image forming apparatus main body 12, in accordance with the closing operation of the upward opening/closing member 20, the support member 134Y and the shutter 136Y move to the exposing position. Further, when the upward opening/closing member 20 is opened with respect to the image forming apparatus main body 12, in accordance with the opening operation of the upward opening/closing member 20, the support member 134Y and the shutter 136Y move to the covering position.

In this manner, in a state where the photoreceptor unit 86Y is attached to the image forming apparatus main body 12 and the upward opening/closing member 20 is closed, the support member 134Y and the shutter 136Y are in the exposing position. That is, the structure can prevent erroneous contact between the photoreceptor drum 90Y and the outside in other cases than image forming operation.

The linkage between opening/closing of the upward opening/closing member 20 and the opening/closing of the support member 134Y and the shutter 136Y is realized with a link mechanism (not shown) or the like.

Next, the details of the developing device 88 will be described. Note that since the developing devices 88Y, 88M, 88C and 88K have the same structure except that corresponding colors are different, the developing device 88Y will be used as a typical example in the following description.

Figure 4:
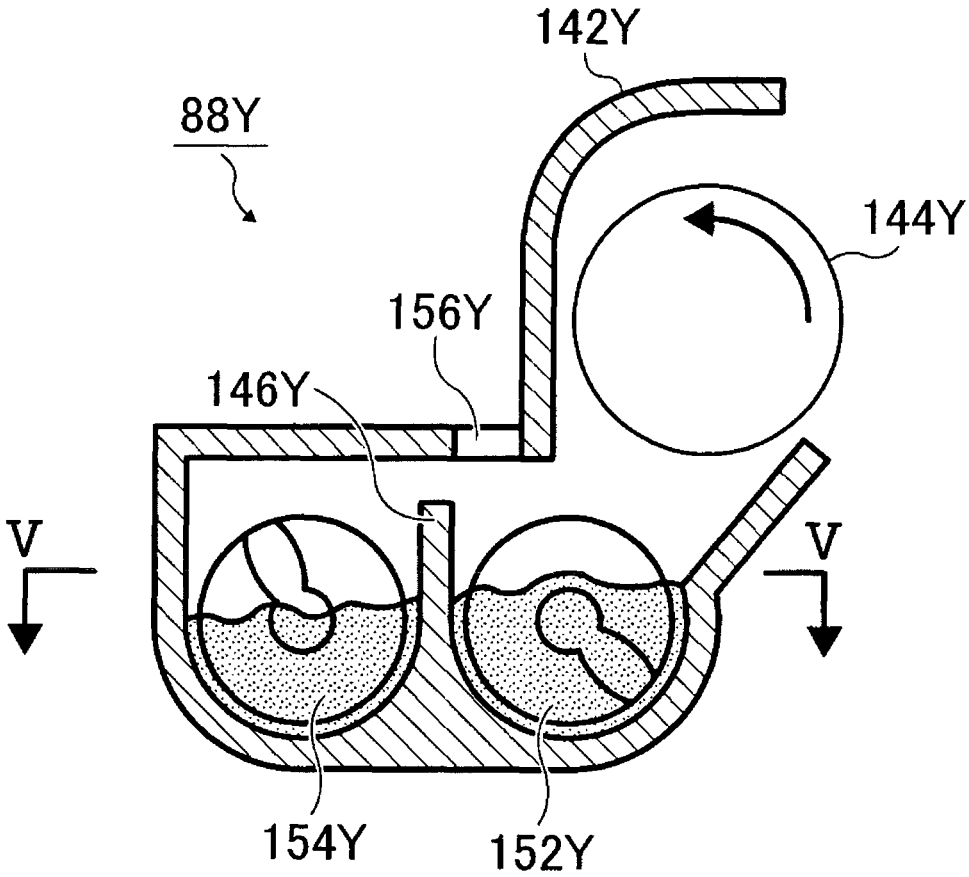
FIG. 4 is a cross-sectional diagram of a developing device.
Figure 5:
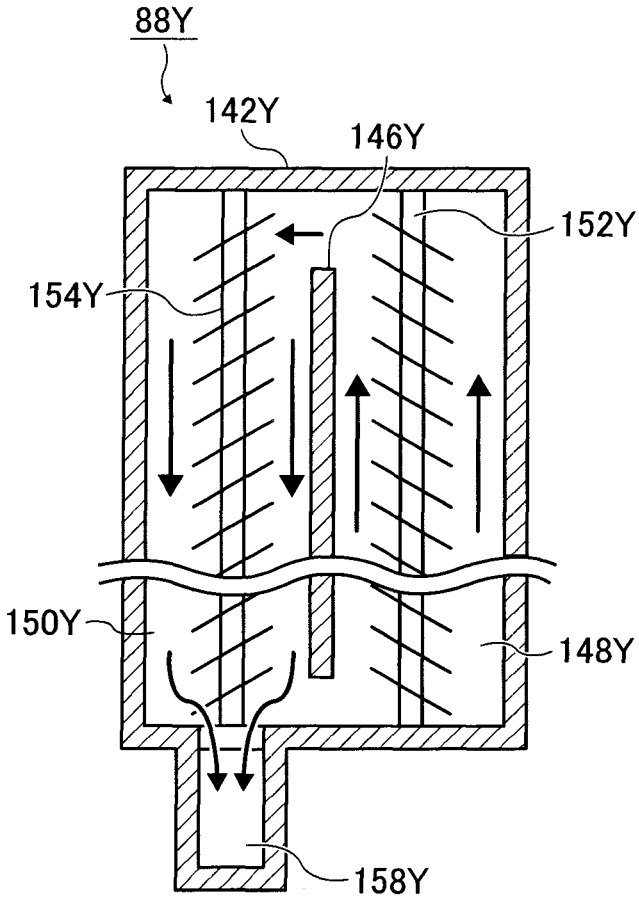
FIG. 5 is a cross-sectional diagram along a line V-V in FIG. 4.

FIG. 4 is a cross-sectional diagram of the developing device 88Y. FIG. 5 is a cross-sectional diagram along a line V-V in FIG. 4.

The developing device 88Y is a two-component type developing device which develops a latent image using two-component developer containing toner and carrier. The developing device 88Y has a developing device main body 142Y which contains the developer.

A developing roller 144Y used as a developer holder is attached in the developing device main body 142Y. The developing roller 144Y rotates in an arrow direction shown in FIG. 4, to supply the developer held on its surface to the photoreceptor drum 90Y (see FIG. 2) and develop a latent image formed on the surface of the photoreceptor drum 90Y.

In the developing device main body 142Y, the space is partitioned into e.g. two spaces with one partition member 146Y, as developer conveyance passages 148Y and 150Y. The developer conveyance passages 148Y and 150Y are used as passages to convey the developer in the developing device main body 142Y.

In the developer conveyance passages 148Y and 150Y, conveyance members 152Y and 154Y to convey the developer while stirring the developer are attached.

A supply hole 156Y and a discharge hole 158Y are formed in the developing device main body 142Y. The developer is supplied from a developer container (not shown) via the supply hole 156Y into the developing device main body 142Y. Further, the developer is discharged via the discharge hole 158Y to the outside of the developing device main body 142Y.

In the developing device 88Y having the above structure, the developer supplied via the supply hole 156Y in the developing device main body 142Y is conveyed with the conveyance member 152Y in the conveyance passage 148Y, and conveyed with the conveyance member 154Y in the conveyance passage 150Y. Then, e.g. some of the developer is finally discharged via the discharge hole 158Y to the outside of the developing device main body 142Y.

In this manner, a new developer is supplied into the developing device main body 142Y and excessive developer is discharged, thereby developing is performed using the newly supplied developer without continuously using developer containing deteriorated carrier.

Figure 6:
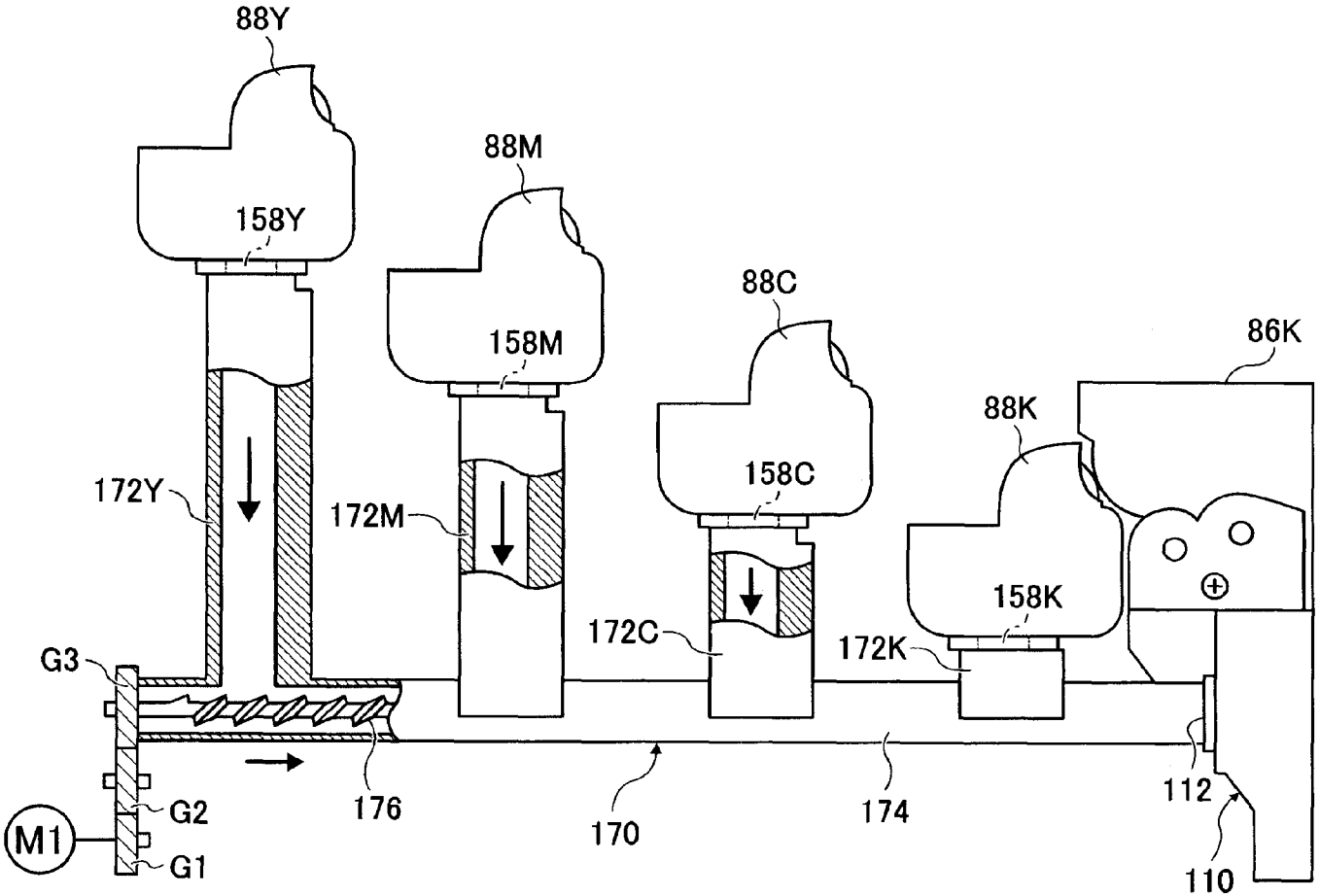
FIG. 6 is a schematic diagram of a developer collection passage and its peripheral structure.

FIG. 6 shows the developer collection passage 170.

The developer collection passage 170 has vertical parts 172Y, 172M, 172C and 172K extending in an approximately vertical direction and a horizontal part 174 connected to these vertical parts 172Y, 172M, 172C and 172K, extending in an approximately horizontal direction.

The vertical parts 172Y, 172M, 172C and 172K have a hollow shape such as a pipe. The upper ends of the vertical parts 172Y, 172M, 172C and 172K are connected to discharge holes 158Y, 158M, 158C and 158K of the respectively corresponding developing devices 88Y, 88M, 88C and 88K. The developers discharged from these discharge holes 158 are dropped in the vertical parts 172 to the horizontal part 174. The horizontal part 174 is connected to an introduction member 112 of the developer collection container 110.

The horizontal part 174 has a hollow shape such as a pipe, in which a conveyance member 176 to convey the developer is inserted in the hollow. The conveyance member 176 receives driving transmitted from a motor M1 via gears G1 to G3. As the conveyance member 176 rotates with the received driving transmitted from the motor M1, the conveyance member 176 conveys the developers drop-conveyed from the vertical parts 172Y, 172M, 172C and 172K toward the developer collection container 110. The developers conveyed in the horizontal part 174 are introduced with the introduction member 112 into the developer collection container 110.

Next, the details of the developer collection container 110 will be described.

Figure 7:
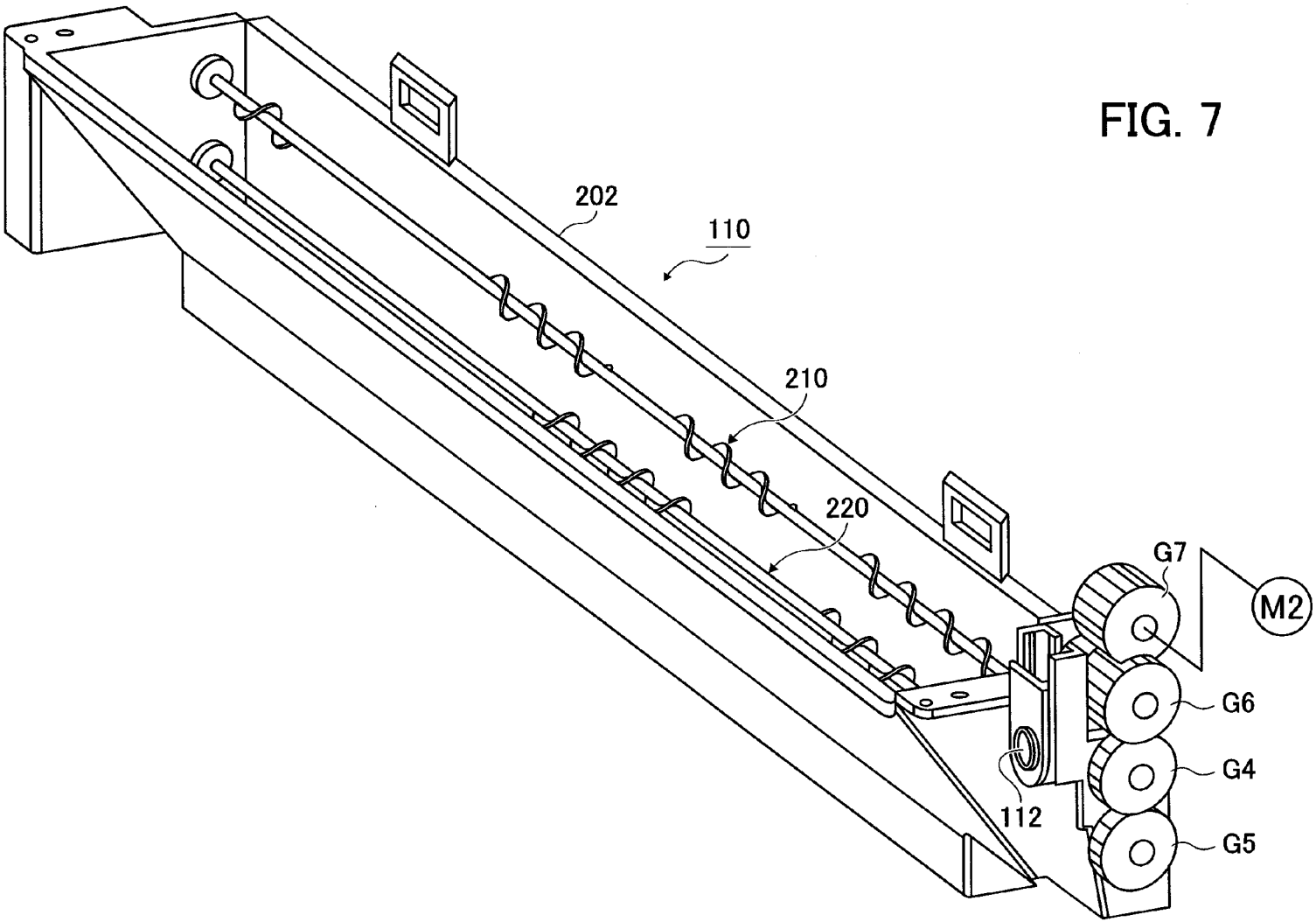
FIG. 7 is a perspective diagram of a developer collection container.
Figure 8:
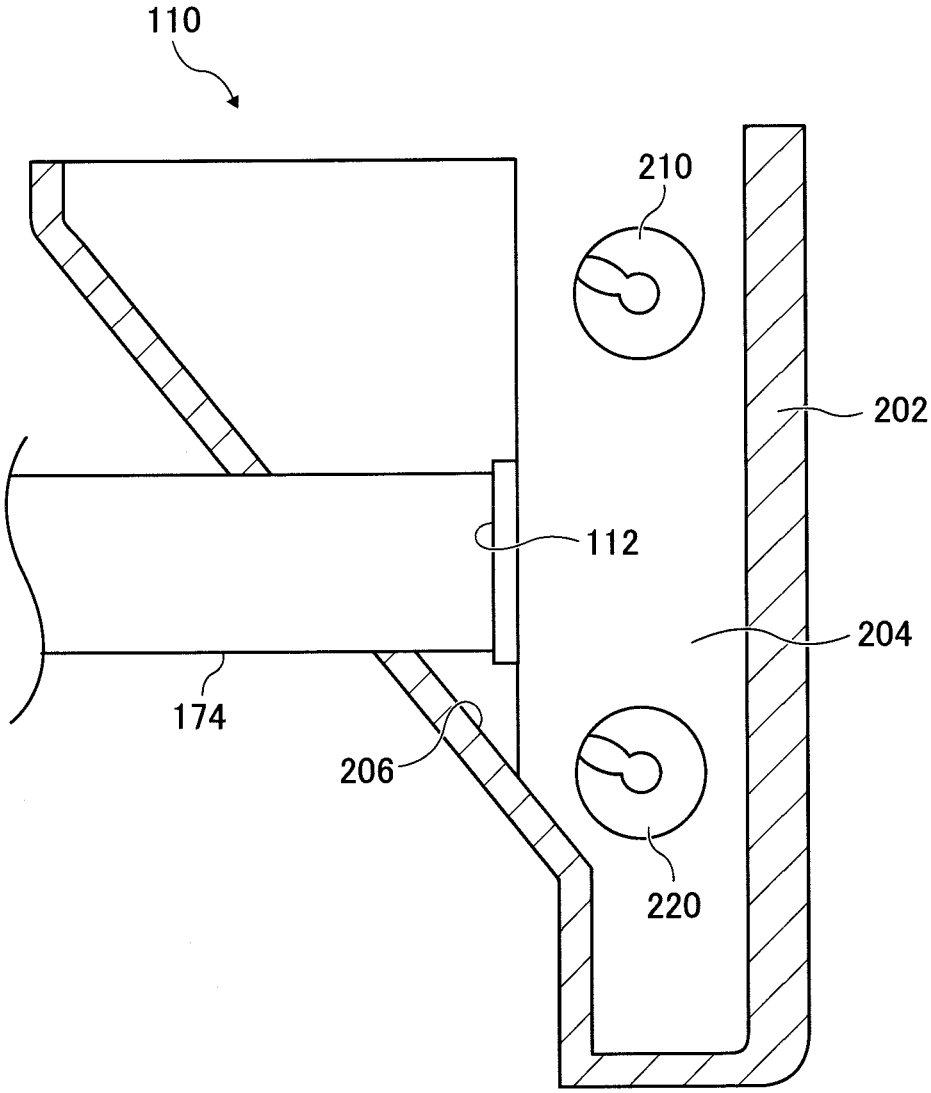
FIG. 8 is a cross-sectional diagram of the developer collection container viewed from a side surface direction.
Figure 9:
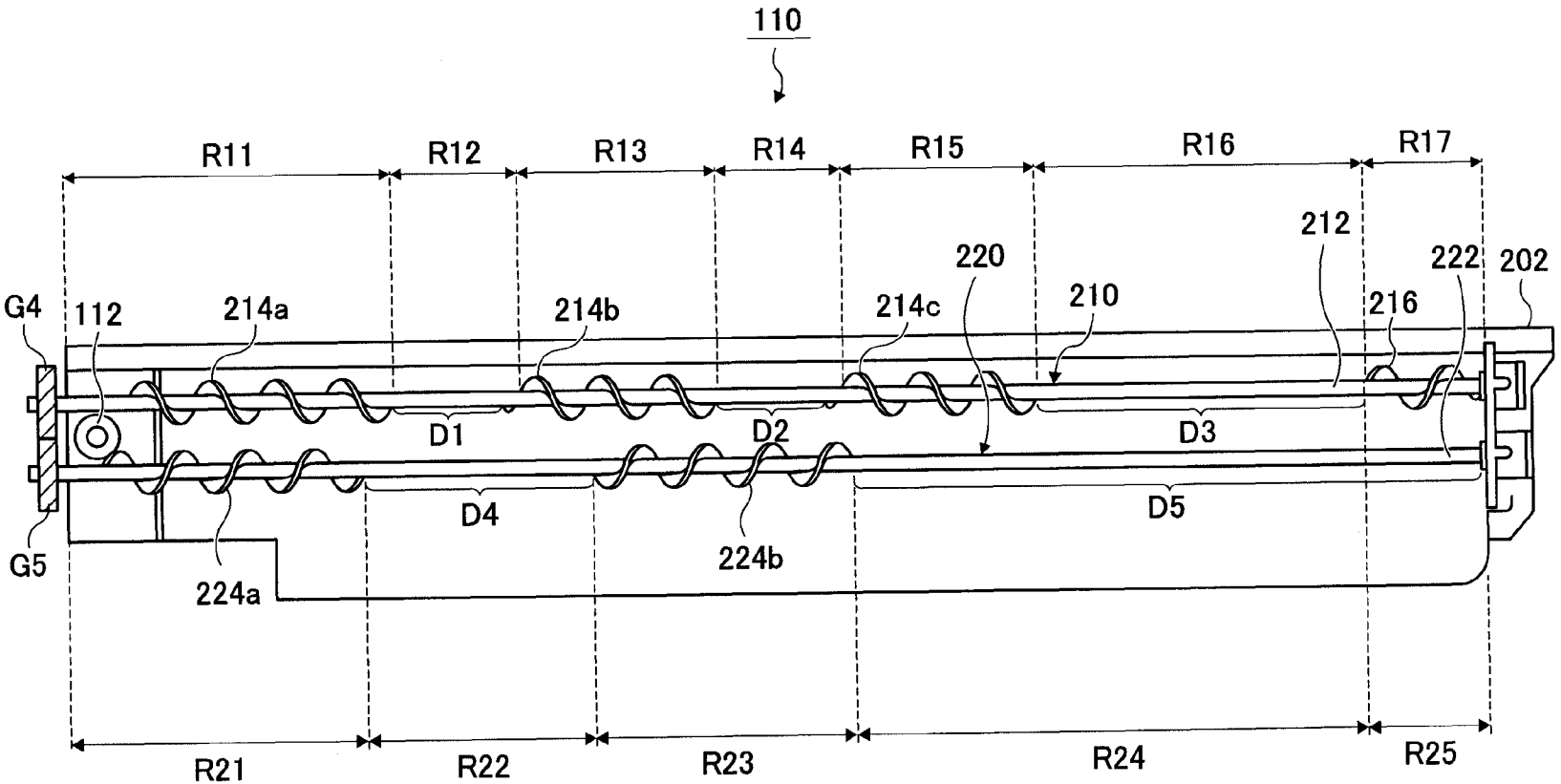
FIG. 9 is a cross-sectional diagram of the developer collection container viewed from a front side.

FIG. 7 is a perspective diagram of the entire developer collection container 110. Further, FIG. 8 is a cross-sectional diagram of the developer collection container 110 viewed from a side surface direction. FIG. 9 is a cross-sectional diagram of the developer collection container 110 viewed from a front side.

The developer collection container 110 has a developer collection container main body 202, and a developer collection chamber 204 is formed in the developer collection container main body 202.

A part of an inner surface of the developer collection container main body 202 forms a slope 206. The developer collected in the developer collection container main body 202 slips on the slope 206 and falls toward the bottom of the developer collection chamber 204.

In the developer collection container 110, the developer including both toner and carrier discharged from the developing device 88 is collected, while the toner removed from the surface of the photoreceptor drum 90 is collected into a collection chamber 132 of the photoreceptor unit 86.

In the developer collection chamber 204, an upper conveyance unit 210 and a lower conveyance unit 220 to convey a developer in the developer collection chamber 204 are provided in upper and lower positions in the gravitational direction.

The upper surface of the developer collection container 110 is a release member. The release member is sealed by attachment of the developer collection container 110 to the photoreceptor unit 86. Further, the release member may be sealed with a lid.

The ends of the upper conveyance unit 210 and the lower conveyance unit 220 are projected to the outside of the developer collection container main body 202, and gears G4 and G5 are attached to the projected portions. The upper conveyance unit 210 and the lower conveyance unit 220 receive driving transmitted from a motor M2 via gears G4 to G7.

The upper conveyance unit 210 and the lower conveyance unit 220 rotate with the driving transmitted from the motor M2, thereby convey the developer introduced from the introduction member 112 to the opposite side to the introduction member 112 (right side in FIG. 9, and hereinbelow, referred to as a "rear side") with respect to a rotation shaft direction of the upper conveyance unit 210 and the lower conveyance unit 220 (hereinbelow, simply referred to as a "rotation shaft direction").

The introduction member 112 is provided in an approximately central position with respect to a height direction of the developer collection container main body 202 and at a height between the upper conveyance unit 210 and the lower conveyance unit 220. Accordingly, the developer discharged from the developing device 88 and conveyed in the developer collection passage 170 is collected from a position between the upper conveyance unit 210 and the lower conveyance unit 220 via the introduction member 112 into the collection container main body 202.

The upper conveyance unit 210 has an upper rotation shaft 212. At least this upper conveyance shaft 212 is provided above the introduction member 112 in the gravitational direction. The upper conveyance shaft 212 is provided with e.g. three spiral-shaped upper conveyance members 214*a*, 214*b* and 214*c* at intervals D1 and D2 from the end on the introduction member 112 side. Further, at a rear side end of the upper rotation shaft 212, a reversing conveyance member 216 in a reverse direction to the upper conveyance member 214 is provided at an interval D3 from the upper conveyance shaft 212*c*.

Accordingly, when the upper conveyance shaft 212 rotates, the upper conveyance member 214 conveys the developer on the introduction member 112 side in the direction of the rear side, and the reversing conveyance member 216 conveys the developer on the rear side in the direction of the introduction member 112 side.

Note that when the developer is continuously conveyed to only in the direction of the rear side direction in the developer collection container main body 202, the developer is densely accumulated on the rear side. As a result, excessive load may be imposed on the rotational driving of the upper conveyance unit 210 and the lower conveyance unit 220. Accordingly, the reversing conveyance member 216 conveys the developer from the rear side in the direction of the introduction member 112 side, so as to prevent dense accumulation of the developer on the rear side.

The upper conveyance members 214*a*, 214*b*, 214*c* form a first upper conveyance region R11, a second upper conveyance region R13, and a third upper conveyance region R15. Further, the intervals D1 to D3 form a first upper non-conveyance region R12, a second upper non-conveyance region R14 and a third upper non-conveyance region R16. The reversing conveyance member 216 forms a reverse conveyance region R17.

The positions in the rotation shaft direction of the upper conveyance unit 210 are in the first upper conveyance region R11, the first upper non-conveyance region R12, the second upper conveyance region R13, the second upper non-conveyance region R14, the third upper conveyance region R15, the third upper non-conveyance region R16 and the reverse conveyance region R17.

The lower conveyance unit 220 has a lower rotation shaft 222. At least this lower rotation shaft 222 is provided below the introduction member 112 in the gravitational direction. The lower conveyance unit 220 is provided with e.g. two spiral-shaped lower conveyance members 224*a* and 224*b* at an interval D4 from the end on the introduction member 112 side. The lower conveyance member 224*b* is provided at an interval D5 from the rear side end.

The lower conveyance members 224*a* and 224*b* have a first lower conveyance region and a second lower conveyance region. Further, the intervals D4 and D5 form a first lower non-conveyance region and a second lower non-conveyance region.

The positions in the rotation shaft direction of the lower conveyance unit 220 are in a first lower conveyance region R21, a first lower non-conveyance region R22, a second lower conveyance region R23, a region R24 in the rear side from the region R23 and not overlapped with the reversing conveyance member 216 (region R17) with respect to the rotation shaft direction, and a region R25 in the rear side from the region R24.

The lower conveyance member 224*b* is provided in a position overlapped with at least the interval D2 between the upper conveyance member 214*b* and the upper conveyance member 214*c* in the rotation shaft direction.

Further, the interval D4 between the lower conveyance member 224*a* and the lower conveyance member 224*b* is provided in a position overlapped with at least a part of the upper conveyance member 214*a* and the interval D1 between the upper conveyance member 214*a* and the upper conveyance member 214*b* in the rotation shaft direction.

The details of mutual positional relation between the respective conveyance regions and non-conveyance regions of the upper conveyance unit 210 and the lower conveyance unit 220 will be described using FIG. 9. Note that for the sake of explanation, in the respective regions, the introduction member 112 side is represented as "beginning" while the rear side, as "ending".

The regions R11 and R21, without disturbing the introduction of developer from the introduction member 112, start from a position to convey the introduced developer in the direction of the regions R12 and R22. The ending of the region R11 is on the rear side from the ending of the region R21.

The beginning of the region R12 is in the rear side from the beginning of the region R22. The ending of the region R12 is on the introduction member 112 side from the ending of the region R22.

The beginning of the region R13 is on the introduction member 112 side from the beginning of the region R23. The ending of the region R13 is on the introduction member 112 side from the ending of the region R23.

The beginning of the region R23 is on the introduction member 112 side from the beginning of the region R15. The ending of the region R23 is on the introduction member 112 side from the ending of the region R15.

The beginning of the region R15 is on the rear side from the beginning of the region R23. The ending of the region R15 is on the rear side from the ending of the region R23.

The beginning of the region R14 is on the rear side from the beginning of the region R23. The ending of the region R14 is on the introduction member 112 side from the ending of the region R23.

In this manner, the beginning of the second and subsequent upper conveyance regions and the beginning of the second and subsequent lower conveyance regions are alternately arranged on the upper and lower sides with respect to the rotation shaft direction.

In the present exemplary embodiment, the upper conveyance member 214*a* provided from the respective introduction member 112 side of the upper rotation shaft 212 and the lower rotation shaft 222, the upper conveyance members 214*b* and 214*c* on the rear side from the lower conveyance member 224*a*, and the lower conveyance member 224*b*, are provided alternately on the upper and lower sides with respect to the rotation shaft direction.

Next, the conveyance of the developer collected in the developer collection container main body 202 will be described. The space in the developer collection container main body 202 is partitioned in the rotation shaft direction, from the end of the introduction member 112 side, (1) the region R21, (2) the region R22, (3) the region R23, (4) a region where the region R24 and the region R15 overlap each other, (5) the region 16 and (6) region R25.

(1) Region R21

In the region R21, the developer discharged from the introduction member 112 is conveyed with the upper conveyance member 214*a* and the lower conveyance member 224*a* to the region R22. With this arrangement, accumulation of the developer around the introduction member 112 (region R21) is suppressed.

(2) Region R22

In the region R22, the developer conveyed from the region R21 is accumulated.

The developer accumulated to the height of the upper conveyance unit 210 is conveyed with the upper conveyance members 214*a* and 214*b* in the direction of the region R23.

When a range where the developer is temporarily accumulated is provided in the region R22 adjacent to the region R21, in comparison with a case without the present structure, the accumulation of the developer around the introduction member 112 is further suppressed.

(3) Region R23

In the region R23, the developer conveyed from the region R22 is accumulated.

The developer accumulated to the height of the lower conveyance unit 220 is conveyed, mainly with the lower conveyance member 224*b*, in the direction of the region R24.

In accordance with the accumulated state of the developer in the developer collection container main body 202, when the developer has been accumulated to the height of the upper conveyance unit 210 in the region R23, the developer is conveyed, with the upper conveyance members 214*b* and 214*c* in addition to the lower conveyance member 224*b*, in the direction of a range R4.

(4) Region where Region R24 and Region R15 Overlap Each Other

In the region where the region R24 and the region R15 overlap each other, the developer conveyed from the region R23 is accumulated.

The developer accumulated to the height of the upper conveyance unit 210 is conveyed with the upper conveyance member 214*c* in the direction of the region R25.

When the regions R23 and R24 are provided around the center of the developer collection container main body 202, in comparison with a case without the present structure, local accumulation of the developer at around the central position can be further suppressed.

(5) Region 16

In the region 16, the developer conveyed from the region where the region R24 and the region R15 overlap each other and the developer conveyed from the region R25 are accumulated.

The region 16 (interval D3) is the greatest (longest) range among the above regions (1) to (6). Accordingly, the largest amount of developer in the above regions (1) to (6) can be contained in the region 16.

When the region 16 is arranged on the rear side from the center of the developer collection container main body 202, in comparison with a case without the present structure, the developer can be more efficiently contained in the developer collection container main body 202.

(6) Region R25

In the region R25, the developer conveyed from the region 16 is accumulated.

The developer accumulated to the height of the upper conveyance unit 210 is conveyed with the reversing conveyance member 216 in the direction of the region 16. Accordingly, in the region R25, dense accumulation of developer can be suppressed.

Further, since the region R25 is positioned at the end of the rear side, the accumulated developer may reach the height of the upper conveyance unit 210 before the height in the region 16 becomes the height of the upper conveyance unit 210. In this case, the reversing conveyance member 216 provided in the upper position conveys the developer to the region R16 having larger capacity than that in the region R25.

In this manner, in the developer collection container 110, the developer can be contained even in a position higher than the introduction member 112.

In the present exemplary embodiment, the upper conveyance member 214 is partitioned into three parts, while the lower conveyance member 224 is partitioned into two parts. However, the present invention is not limited to this arrangement. The partitioning may be arbitrarily changed in correspondence with the size or the like of the developer collection container 110.

Further, the reversing conveyance member 216 may be provided in the both upper conveyance unit 210 and the lower conveyance unit 220.

Further, seen from the rotation shaft direction, the rotation shafts of the upper conveyance unit 210 and the lower conveyance unit 220 overlap each other in the vertical direction. However, the rotation shafts may be shifted in the horizontal direction within a range where the developer can be conveyed. For example, when there is no problem in a state where, seen from the rotation shaft direction, at least parts of the upper conveyance unit 210 and the lower conveyance unit 220 may be overlap each other in the vertical direction, the upper conveyance unit 210 and the lower conveyance unit 220 may be shifted in the horizontal direction.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer collection container comprising:

a developer collection container main body that forms a developer collection chamber in which developer is collected;

a first developer conveyance member, provided inside the developer collection container main body, that conveys the developer by rotating about a shaft; and a second developer conveyance member, provided below the first developer conveyance member with respect to a gravitational direction in the developer collection container main body, that conveys the developer by rotating about a shaft, the developer collection container main body having a collected developer introduction member that introduces the developer to the developer collection chamber being provided between the first developer conveyance member and the second developer conveyance member with respect to the gravitational direction.

2. The developer collection container according to claim 1, wherein the first developer conveyance member and the second developer conveyance member respectively have a plurality of conveyance regions where conveyance members are formed and a plurality of non-conveyance regions without conveyance member, and at least a part of at least one of the non-conveyance regions in at least one of the first developer conveyance member and the second developer conveyance member overlaps with another conveyance region in a shaft direction.

3. The developer collection container according to claim 2, wherein at least one of the non-conveyance regions of the first developer conveyance member overlaps the conveyance region of the second conveyance member in the shaft direction.

4. The developer collection container according to claim 1, wherein of the first developer conveyance member and the second developer conveyance member, at least the first developer conveyance member is provided with a reverse conveyance member that conveys the developer in a reverse direction to the conveyance member.

5. The developer collection container according to claim 2, wherein of the first developer conveyance member and the second developer conveyance member, at least the first developer conveyance member is provided with a reverse conveyance member that conveys the developer in a reverse direction to the conveyance member.

6. The developer collection container according to claim 3, wherein of the first developer conveyance member and the second developer conveyance member, at least the first developer conveyance member is provided with a reverse conveyance member that conveys the developer in a reverse direction to the conveyance member.

7. An image forming apparatus comprising:

an image forming apparatus main body;

a developer image forming unit, provided in the image forming apparatus main body, that forms a developer image; and a developer collection container that collects developer discharged from the developer image forming unit, the developer collection container having:

a developer collection container main body that forms a developer collection chamber in which the developer is collected;

a first developer conveyance member, provided inside the developer collection container main body, that conveys the developer by rotating about a shaft; and a second developer conveyance member, provided below the first developer conveyance member with respect to a gravitational direction in the developer collection container main body, that conveys the developer by rotating about a shaft, and the developer collection container main body having a collected developer introduction member that introduces the developer to the developer collection chamber being provided between the first developer conveyance member and the second developer conveyance member with respect to the gravitational direction.

* * * * *